United States Patent [19]

Folsberg

[11] Patent Number: 4,626,343

[45] Date of Patent: Dec. 2, 1986

[54] SEPARATOR FOR SORTING PARTICULATE MATERIAL

[75] Inventor: Jan Folsberg, Copenhagen, Denmark

[73] Assignee: F. L. Smidth & Co. A/S, Copenhagen, Denmark

[21] Appl. No.: 760,820

[22] Filed: Jul. 31, 1985

[30] Foreign Application Priority Data

Aug. 13, 1984 [GB] United Kingdom ..... 8420566

[51] Int. Cl.[4] ..... B07B 7/083; B07B 13/16

[52] U.S. Cl. ..... 209/138; 209/144; 209/154; 241/79.1; 241/114; 55/412; 55/417

[58] Field of Search ..... 209/138, 139 R, 139 A, 209/144, 154; 241/119, 79.1, 121, 79; 55/410, 417, 412

[56] References Cited

U.S. PATENT DOCUMENTS

| | | | |
|---|---|---|---|
| 1,746,686 | 2/1930 | Sturtevant | 209/139.2 |
| 1,779,993 | 9/1930 | Sturtevant | 209/139.2 |
| 1,933,604 | 11/1933 | Sturtevant | 209/139.2 |
| 1,958,816 | 5/1934 | Gibson | 209/139.2 |
| 2,434,037 | 1/1948 | Ebersole | 209/139.1 |
| 2,762,573 | 9/1956 | Culp | 209/144 X |
| 3,265,209 | 8/1966 | Wochnowski | 209/154 X |
| 3,670,886 | 6/1972 | Hosokawa et al. | 209/139.2 |
| 4,171,960 | 9/1979 | Jarvenpaa | 209/144 |
| 4,260,478 | 4/1981 | Hosokawa | 209/139.2 |

FOREIGN PATENT DOCUMENTS

| | | | |
|---|---|---|---|
| 411123 | 5/1934 | United Kingdom | 55/412 |
| 421384 | 3/1974 | U.S.S.R. | 209/138 |

*Primary Examiner*—S. Leon Bashore
*Assistant Examiner*—Thomas M. Lithgow
*Attorney, Agent, or Firm*—Brumbaugh, Graves, Donohue & Raymond

[57] ABSTRACT

A separator for sorting particulate material suspended in a conveying gas into coarse and fine fractions has a rotor (1) with two sets (9,10) of vanes. Dampers (13,14) in outlet ducts for the fine fraction regulate the relative flow through the two vane sets and hence control the cut between the fine fraction and the coarse fraction which is flung centrifugally outwards by the vanes and falls down inside a casing (3).

4 Claims, 3 Drawing Figures

SEPARATOR FOR SORTING PARTICULATE MATERIAL

The inventor relates to a separator for sorting particulate material suspended in a conveying gas into a fine fraction and a coarse fraction, the separator comprising a rotor with vanes and a housing encasing the rotor and having an inlet duct leading to one end of the rotor for the supply of unsorted material and an outlet duct leading from the other end of the rotor for discharging the separted fine fraction. Such a separator is hereinafter referred to as of the kind described.

In such a separator the material/gas suspension is conveyed past the rotating vanes, where the coarser fraction is flung outwards towards the wall by centrifugal force. As the gas stream velocity at the wall is insufficient to entrain the coarser particles, the latter will fall down along the wall to the bottom of the separator while the finer fraction of the material remains entrained in the gas stream and is conveyed past the vaned rotor and out through the outlet duct of the separator to be subsequently separated from the gas, e.g. by a precipitator arrangement.

The separated fine fraction will consist of nearly all the particles below a certain first, smaller grain size, while the coarse fraction will consist of nearly all the particles above a certain second, larger grain size. Additionally, in both the fine and coarse fraction, there will be a distribution of an intermediate fraction comprising grain sizes between the first and second grain sizes. The distribution of grains of intermediate sizes is a result of the inability of the separator of to have a precise grain size cut-off point, such that all particles below a certain size pass through the rotor, and all particles above that size are flung to the wall.

The difference in size between the first and second particle sizes indicates a separation sharpness and this separation sharpness as well as the cut size of the separator, i.e. the desired grain size limit between the coarse and the fine fraction, are characteristics of the design of the vaned rotor. With such a rotor known for instance from FIG. 1 of EP-A-0073567, it is, however, only possible to vary these characteristics of ths separator and thereby the grain size distribution in the finished product (fine fraction) by adjusting the rotation speed of the rotor and the suspension velocity through the separator.

Another known way to influence the characteristics of the separator, i.e. the grain size distribution in the finish sorted product, is to use two or more separators of the above kind in combination, e.g., working in parallel or in series.

It is an object of the present invention to improve the capability of varying the characteristics of a separator of the kind described, and, according to the invention, this is achieved in that the rotor comprises at least two sets of vanes with different sorting characteristics, and in that control devices are provided for regulating the relative proportions of conveying gas through the different rotor vane sets.

By such a separator it is possible, in a hitherto not achievable degree, to influence the grain size distribution in the finish separated product. Through different sorting characteristics of the different rotor vane sets through the possibility of controlling the suspension flow rate through the vane sets it is a further advantage that the above control of the separator and thereby of the product quality can be controlled even during operation.

The simple and compact rotor construction of the separator makes the apparatus especially suitable as a built-in separator at the top of a vertical roller mill, and may increase considerably the applicability of such a mill.

The separator may advantageously be constructed in such a way that the vane sets each have separate oulet passages connected to the separator outlet duct and that the flow control devices are mounted in the outlet passages.

In an alternative construction, the control devices may comprise an extension of the outlet duct axially adjustable in relation to the other end of the rotor.

Some examples of a separator constructed in accordance with the invention are illustrated in the accompanying drawings, in which.

Figure 1:
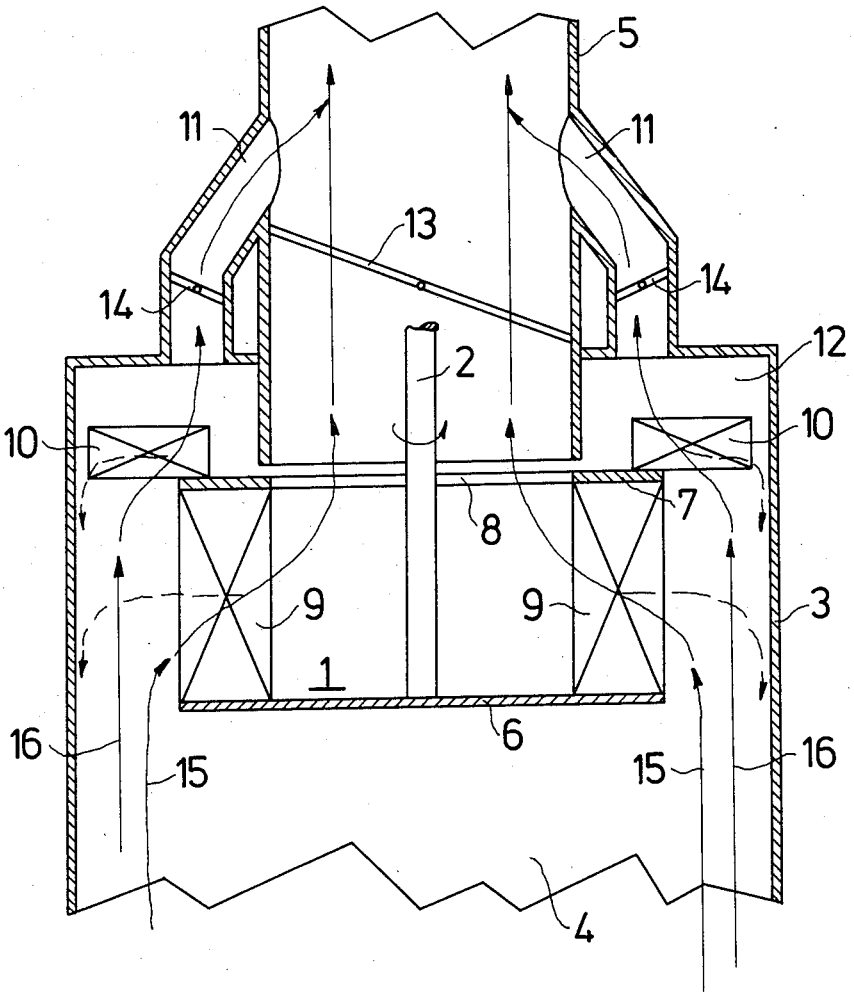
FIG. 1 is an axial sectional view through one separator with a preferred position of two sets of rotor vanes.

The separator of FIG. 1 has a rotor 1 which is rotatable about a vertical axis and driven by a motor not shown, via a shaft 2. The rotor is encased by a cylindrical housing 3, the lower part of which also constitutes an inlet duct 4 for supplying unsorted material suspended in a conveying gas to the lower end of the rotor 1.

At the top of the housing 3 is an outlet duct 5 for carrying away a fine fraction of the material separated in the rotor.

The rotor 1 has a solid bottom plate 6 and a top plate 7 with a central outlet opening 8 from which the duct 5 leads.

Between its bottom and top plates 6 and 7 the rotor as a first set of substantially radial vanes 9, and, fastened to the top plate 7 of the rotor, a second set of substantially radial vanes 10.

Above the second vane set 10 are outlet ducts 11 connecting an upper zone 12 within the housing 3 with the duct 5.

The ducts 5 and 11 are provided with control devices, for instance in the form of dampers 13 and 14, respectively.

Figure 2:
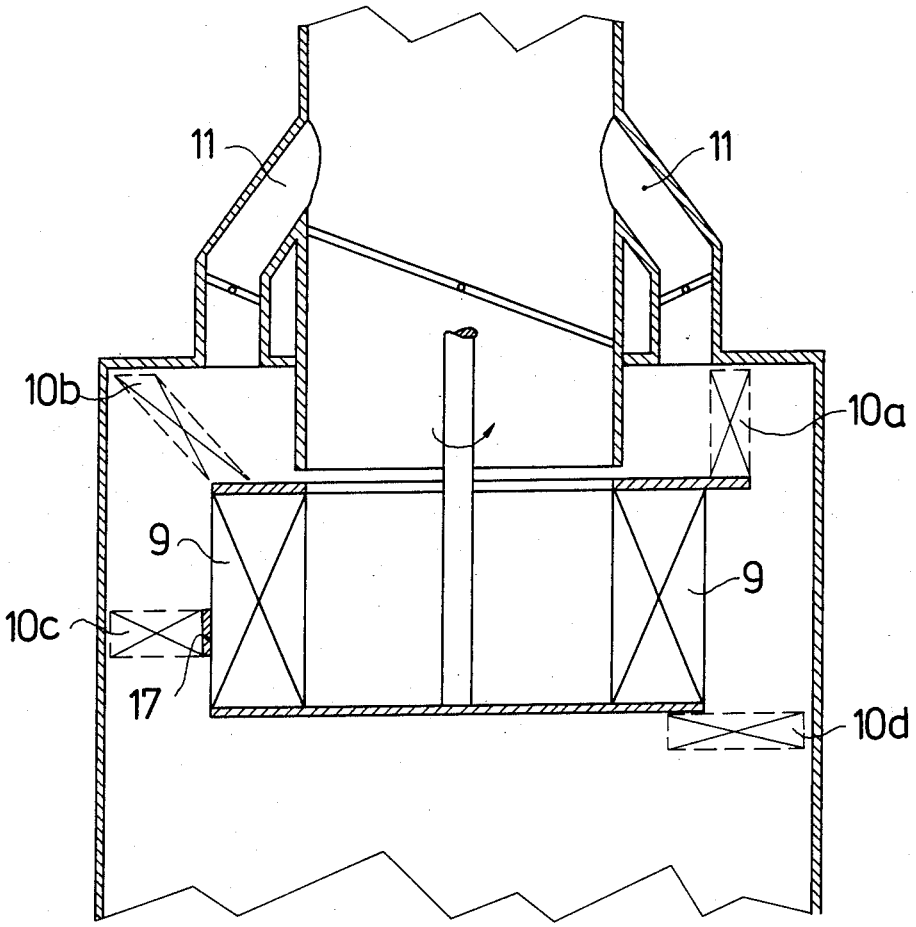
FIG. 2 is a similar view, but indicating alternative positions of the second set of rotor vanes; and, FIG. 3 is a similar view to FIG. 1, but showing an alterative flow control device.

In FIG. 2 as illustrated by the dotted vanes 10*a*, 10*b*, 10*c* and 10*d* how alternative positions of the vane sets may be made.

The set of vanes 10*c* may be further fastened axially adjustably e.g. on a ring 17 surrounding the vanes 9, to provide a regulating means for the separator.

The separator operates in the following way. The material to be sorted in the separator is supplied, suspended in conveying gas, upwards within the lower part 4 of the housing 3 from where part of the suspension flows into the rotor, passing as shown in FIG. 1 the first set of vanes 9, out of the rotor through the central opening 8 in plate 7 and into the duct as indicated by arrows 15, whereas the remaining part of the suspension flows directly upwards and into the second set of vanes 10, through the space 12 and out through the outlet ducts 11 into the duct 5 as indicated by full line arrows 16.

During the passage of the rotating vanes 9 or 10 the heavier grains are flung in known manner by the centrifugal forces provided by the rotor 1, as indicated by dotted arrows, towards the encasing housing 3, and fall down along the wall of the latter towards the bottom of the housing for further treatment, for instance in a mill below the separator.

As the two sets of vanes 9 and 10 have different sorting characteristics, it is possible by means of the dampers 13 and 14 in the outlet ducts 5 and 11, respectively, to control the gas flow rates through the two sets of vanes and thereby appropriately to combine the relative parts of the fine fractions from the two vane sets during operation of the separator and thus obtaining a desired grain size distribution in the finished product leaving the separator via the outlet 5.

The combined position of the two vane sets 9 and 10 shown in FIG. 1 provides for a parallel separation, i.e. the two streams 15 and 16 of the suspension each pass one vane set only.

The vanes 10*a* and 10*b* shown in FIG. 2 function in the same way in relation to the vanes 9 as the vanes 10 in FIG. 1, that is in parallel separation, whereas the vanes 10*c* and 10*d* function in a combination of parallel and series in relation to the vanes 9, i.e. a stream of the suspension may pass through two sets of vanes.

Thus regarding the vanes 10*c* a first stream of the suspension will pass the vanes 9 only, while a second stream will pass both the vanes 10*c* and 9 and a third stream only the vanes 10*c*.

Regarding the vanes 10*d* all the suspension passes the vanes 10*d* and from there a stream also passes the vanes 9, whereas the remaining part is led directly to the outlet ducts 11.

Figure 3:
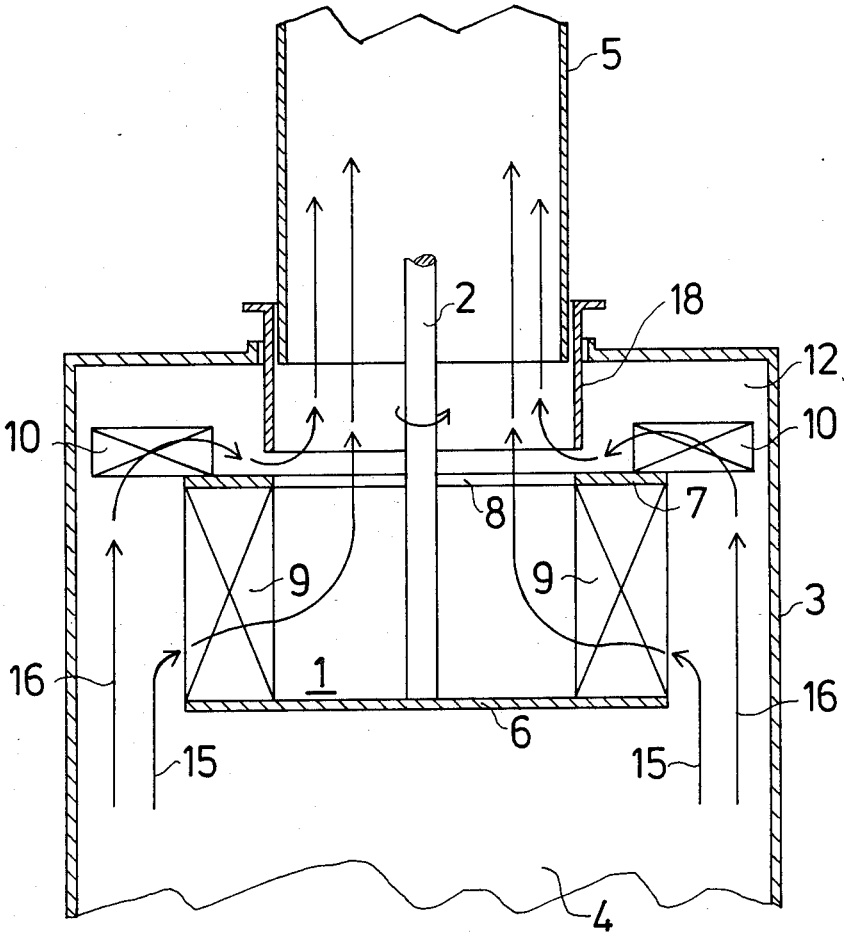

FIG. 3 illustrates another construction of the control device for regulating the gas flow through the second vane set 10 and thereby the gas flow rates through the two vane sets.

The control device consists of an extension 18 of the outlet duct 5, the extension 18 being axially adjustable in relation to the top plate 7 of the rotor 1.

Thus in all arrangements, the relative proportions of the suspension passing through the two different vane sets is variable.

I claim:

1. In a separator for sorting particulate material suspended in a conveying gas into a fine fraction and a coarse fraction, the separator being of the kind comprising a rotor with two end plates and vanes, means to rotate the rotor, and a housing encasing said rotor and having an inlet duct leading to one end of said rotor for the supply of unsorted material and an outlet duct leading from an opposite end of said rotor for discharging said separated fine fraction, the improvement wherein said rotor comprises two sets of vanes with different sorting characteristics, and in that control means are provided for regulating the relative proportions of said conveying gas through different ones of said two vanes sets, said control means comprising separate outlet passages connected to said separator outlet duct with means mounted in each outlet passage to control the conveying gas through its respective passage.

2. A separator according to claim 1, wherein a first one of said vane sets is mounted between two end plates of said rotor and a second one of said vane sets is mounted on one of said end plates.

3. A separator according to claim 1, wherein a second one of said vane sets is mounted axially adjustably relatively to a first one of said vane sets.

4. A separator according to claim 3, wherein said second vane set is mounted on a ring surrounding and axially slidable on outer ends of said first vane set.

* * * * *